United States Patent [19]

Smith

[11] Patent Number: 4,713,598

[45] Date of Patent: Dec. 15, 1987

[54] POWER SUPPLY ASSOCIATED WITH AC LINE RELAY SWITCH

[75] Inventor: Edgar M. Smith, Lancaster County, Pa.

[73] Assignee: RCA Corporation, Princeton, N.J.

[21] Appl. No.: 924,317

[22] Filed: Oct. 29, 1986

[51] Int. Cl.[4] ..... G05F 1/00

[52] U.S. Cl. ..... 323/245; 363/126

[58] Field of Search ..... 363/61, 126; 323/320, 323/324, 239, 245

[56] References Cited

U.S. PATENT DOCUMENTS

| | | | |
|---|---|---|---|
| 3,177,421 | 4/1965 | Montgomery | 363/61 |
| 3,805,184 | 4/1974 | Visioli, Jr. et al. | 323/245 X |
| 4,586,122 | 4/1986 | Self | 363/126 |

FOREIGN PATENT DOCUMENTS

| | | | |
|---|---|---|---|
| 0898571 | 1/1982 | U.S.S.R. | 363/126 |

*Primary Examiner*—Peter S. Wong

*Attorney, Agent, or Firm*—Vincent J. Coughlin, Jr.

[57] ABSTRACT

A relay switch in an ac main line has a dc-powered applying for applying amplified control sensor signals to the control circuit of the relay switch. To provide dc power for the amplifier when the relay switch main controlled current conduction path is conductive, a current transformer primary winding is arranged in series with that path, and the voltage appearing across the secondary winding is rectified. To provide dc power for the amplifier when the relay switch main controlled current conduction path is non-conductive, an open-circuit voltage related to that appearing across the open-circuit non-conductive path is rectified. To permit the use of one rectifier for developing dc power for the amplifier it is advantageous to apply the open-circuit voltage to the secondary winding of the current transformer through a dc-blocking capacitor with sufficient ac impedance to restrict ac flow across the open-circuit relay switch path.

14 Claims, 6 Drawing Figures

POWER SUPPLY ASSOCIATED WITH AC LINE RELAY SWITCH

The present invention concerns a power supply circuit for generating power from a switched ac conductor.

BACKGROUND OF THE INVENTION

Passive infrared (PIR) detectors are coming into use to control the switching of ac mains. The PIR detector can have its heat sensor mounted on the face plate of a standard electrical connection box containing the electric relay switch that selectively connects the ac power through the box under control of the heat sensor. The electric relay switch may be of electromechanical type or of semiconductor switching device type, by way of examples. The small electric power output of the heat sensor is customarily amplified to obtain enough power to control the electric relay switch. The dc power supply for this amplifier is difficult to provide for when ac common is not routed through the box, since there is no alternating potential difference readily available from which to generate direct potential.

SUMMARY OF THE INVENTION

To solve this problem in accordance with the invention, the primary winding of a current transformer is placed in series with the controlled main conduction path of the relay switch in an ac main line. When the relay switch is conductive through this path, alternating potential appearing across the secondary winding of the current transformer is rectified to furnish dc power supply for the amplifier between the PIR detector and the electric relay switch control circuit. When conduction through the controlled main conduction path of the relay switch is discontinued, alternating potential appearing across the resulting open circuit is rectified to furnish dc power supply for the amplifier. The invention may also be embodied in other apparatus using a relay switch in an ac mains lead where the relay switch is controlled by other means than a PIR detector—e.g., by a touch detector for detecting the touch of a human hand.

DETAILED DESCRIPTION

Figure 1:
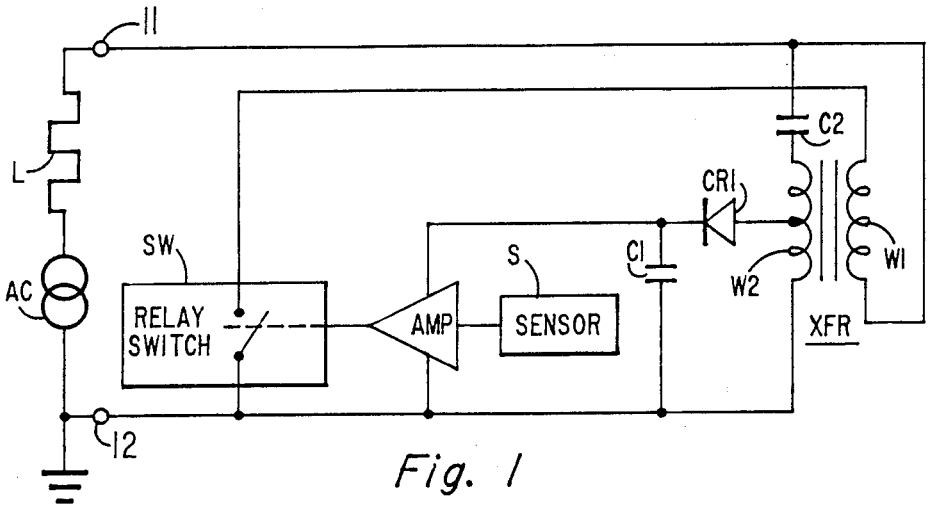
FIGS. 1, 2 and 3 are block schematic diagrams of various embodiments of the invention.

In FIG. 1 the primary winding W1 of a current transformer XFR and the main controlled current conduction path of a relay switch SW are arranged in series between points of connection 11 and 12. The ac mains alternator AC and switched load L are connected in circuit between points of connection 11 and 12. A sensor S responds to an input parameter to generate electric signals responsive to which an amplifier AMP furnishes control signals to the control circuit of the relay switch SW.

The generation of dc power for amplifier AMP is of particular interest, especially when short-circuit conduction through the main controlled current conduction path of relay switch SW causes the alternating potential between points of connection 11 and 12 to fall to very low value, in order to apply substantially the entire mains voltage from alternator AC to load L. The alternating potential drop across the primary winding of current transformer XFR at this time is relatively very small compared to the alternating potential drop across load L, typically being no more than a volt or so of the 100+ volts supplied by alternator AC. This small voltage is transformed up in the secondary winding W2 of the current transformer XFR. All or a portion of the voltage across winding W2 is rectified to provide dc power to amplifier AMP during this time. This rectification is shown in FIG. 1 as being done by a current rectifier diode CR1, with a capacitor C1 shunting the supply of dc power to amplifier AMP and functioning as a simple voltage smoothing filter.

When sensor S electric signals, as amplified by amplifier AMP, are such that conduction through the main controlled current conduction path of relay switch SW is interrupted, there is no current flow through primary winding W1 of the current transformer XFR. Accordingly, there is no transformed voltage across secondary winding W2 to be used as a source of power for amplifier AMP. An alternative method of applying alternating potential across windings W2 is used, so at least a portion of this potential can continue to be used to supply power to amplifier AMP. Advantage is taken of the fact that there is no longer alternating potential drop across load L nearly equal to alternator AC source potential. Substantially the full source potential of alternator AC appears between points of connection 11 and 12. This potential is applied across winding W2 through sufficient impedance to prevent substantial ac through load L, a dc-blocking capacitor C2 shown being used for this purpose in FIG. 1.

Figure 2:
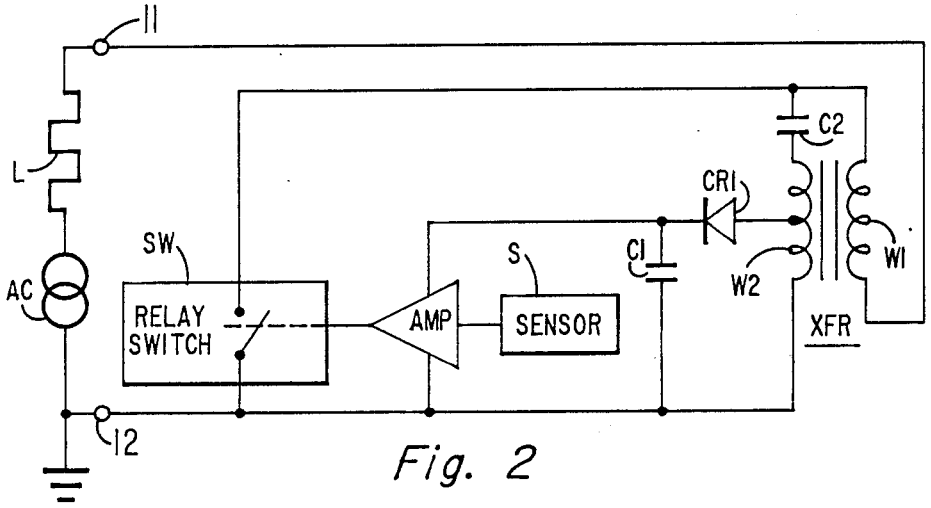

FIG. 2 shows a simple variant of the FIG. 1 circuitry where C2 connects to point of connection 11 through winding W1 instead of directly.

Figure 3:
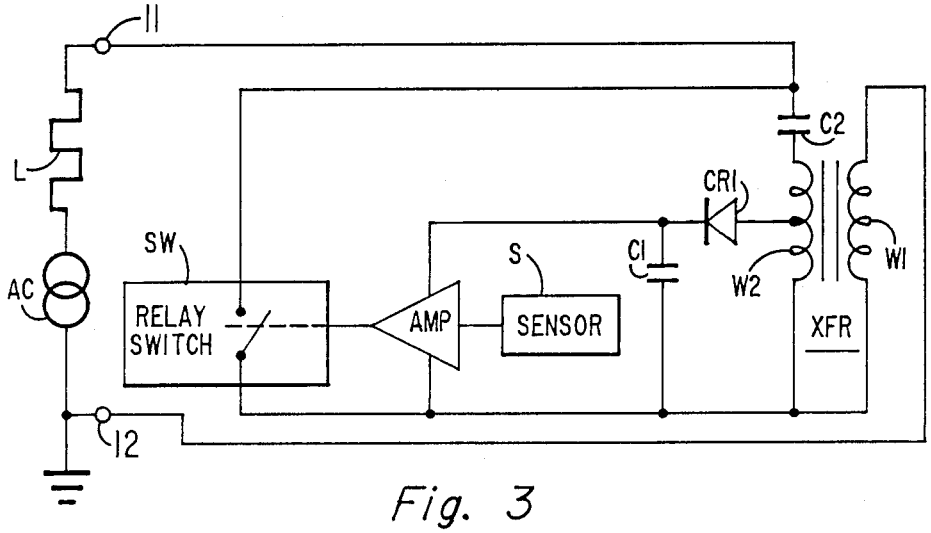

FIG. 3 shows a further variant, similar to FIG. 2 except for the order of serial connection of winding W1 and the main controlled current conduction path of relay switch SW being reversed. The FIG. 3 circuit has a cost advantage in that XFR can be continuously wound with the common connection between windings W1 and W2 being brought out from the winding as a single lead.

Figure 4:
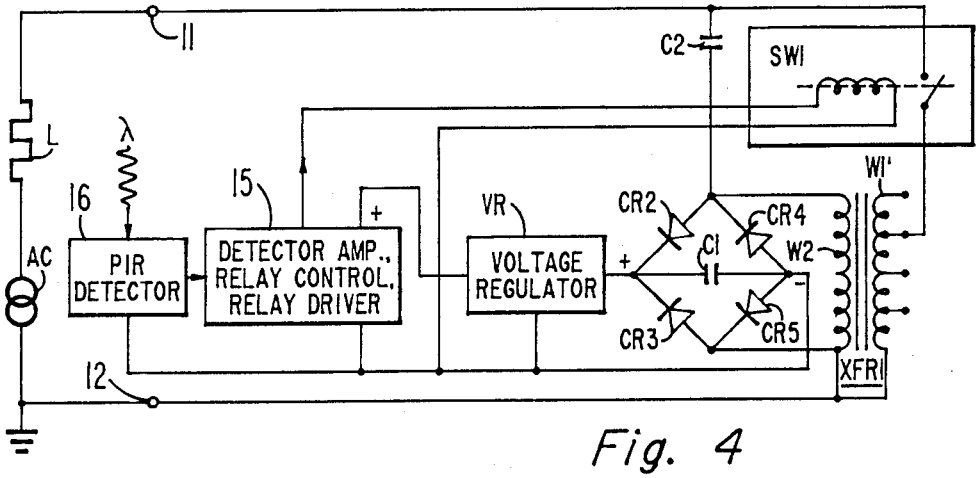
FIGS. 4 and 5 are more complete schematic diagrams of relay switches controlled by PIR detectors in accordance with the invention, an electromagnetic relay switch being used in FIGS. 4 and 5, and a triac being used as a relay switch in FIG. 6.

FIG. 4 shows one PIR-detector-controlled switch design developed for commercial use. The relay switch SW1 is an electromechanical type with an electromagnetic coil being used to regulate the position of electrical contacts controlling conduction in the main controlled current conduction path. The electromechanical relay switch SW1 requires no heat sinking and easily accommodates reactive loads such as florescent lighting. A full-bridge rectifier comprising current rectifier diodes CR2, CR3, CR4 and CR5 rectifies the secondary winding W2 voltage. This rectified voltage is used as input for a voltage regulator VR, which supplies power to the infrared-detector amplifier, relay control and relay driver circuits 15. Passive infrared detector 16 is the sensor, responding to incident infrared radiation λ. The primary winding W1′ of current transformer XFR1 has several taps so the turns ratio between windings W1′ and W2 can be adjusted to suit the load. E.g., for L being a 60-watt load, winding W1′ has 45 turns and winding W2 has 2000 turns.

Figure 5:
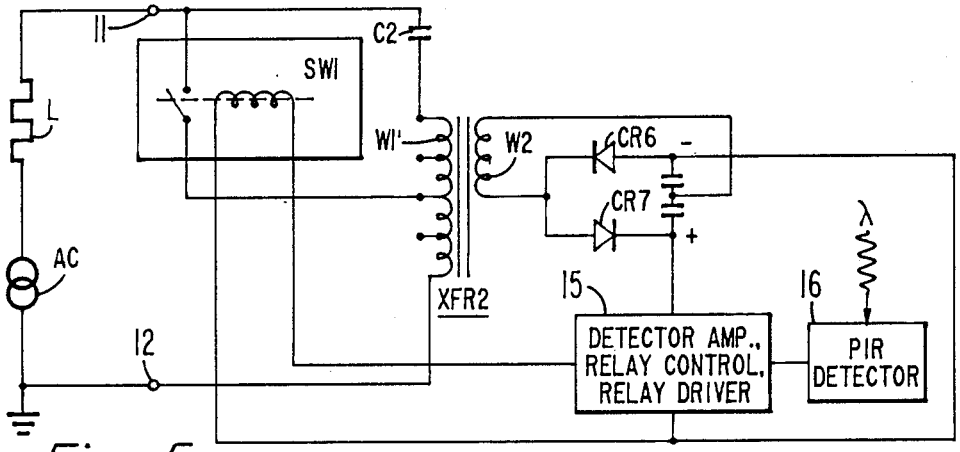

FIG. 5 shows another PIR-detector-controlled switch design, in which the dc power supply is isolated from the ac mains. This facilitates the PIR detector 16 and circuits 15 being located remotely from the relay switch SW1. The secondary winding W2 of current transformer XFR1 supplies a half-bridge rectifier comprising current rectifiers CR6 and CR7 to provide the dc power supply for circuitry 15. The dc blocking capacitor C2 applies the open-circuit ac mains voltage across primary winding W1', rather than secondary winding W2, to help in isolating the dc power supply.

Figure 6:
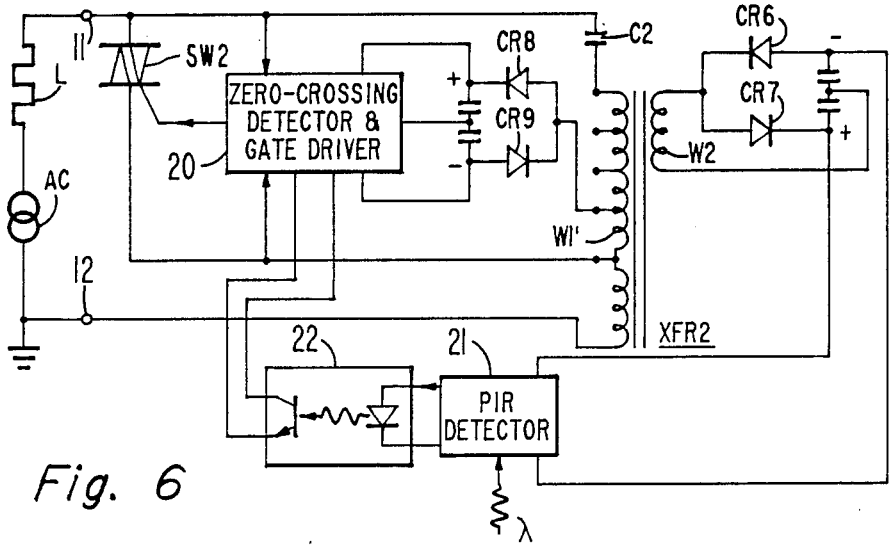

FIG. 6 shows still another PIR-detector-controlled switch, designed for incandescent lamp loads. A triac SW2 is used as the relay switch. Current transformer XFR2 has a portion of its multi-tapped primary winding W1' supplying ac to a half-bridge rectifier comprising current rectifier diodes CR8 and CR9. This half-bridge rectifier develops balanced dc power for supply voltages zero-crossing detector and gate drive circuitry 20. XFR2 also has a secondary winding W2 with another half-bridge rectifier comprising current rectifier diodes CR6 and CR7 for developing an isolated dc power supply for PIR detector circuitry 21. An opto-isolator 22 conveys PIR detector indications to the gate drive circuitry 20 for controlling triac SW2 conduction.

The switches shown in FIGS. 1–6 may be arranged to conduct current to load L either only responsive to infrared being present in greater than given degree or only responsive to infrared being present in lesser than given degree.

What is claimed is:

1. A switch for an ac main line comprising:

first and second points of connection to respective portions of said ac main line that are to be selectively connected by said switch;

a transformer having a primary winding and secondary winding each having respective first and second ends, the first end of said primary winding connecting to said first point of connection, the turns ratio between said secondary and primary windings being sufficiently high that said transformer behaves as a current transformer with regard to said primary winding connection;

a relay switch, providing a main controlled current conduction path between its connections to the second end of said primary winding and to said second point of connection, and having a control circuit for receiving a control signal that controls selective conduction through the main controlled current conduction path of said relay switch;

control means for applying said control signal to the control circuit of said relay switch; and means for supplying dc power to said control means, including:

means for rectifying at least a portion of the voltage appearing across said secondary winding when the main controlled current conduction path of said relay switch provides closed-circuit conduction, and means for rectifying a portion of the voltage appearing between said first and second points of connection when the main controlled current conduction path of said relay switch is relatively open-circuit nonconductive.

2. A switch as set forth in claim 1 wherein said control means includes:

a sensor for generating electric signal indicative of a sensed physical parameter; and an amplifier, receptive of dc power from said means for supplying ac power to said control means, and responsive to said electrical signal indicative of a sensed physical parameter for generating said control signal.

3. A switch as set forth in claim 2 wherein said sensor is a passive infrared detector.

4. A switch as set forth in claim 1 having:

means for providing an impedance path in series connection with said second winding between said first and second points of connection; and means for rectifying at least a portion of the voltage appearing across said second winding irrespective of the condition of conduction through the main controlled current conduction path of said relay switch, included in both previously claimed means for rectifying.

5. A switch as set forth in claim 4 wherein said means for providing an impedance path includes a capacitor in series connection with said second winding between said first and second points of connection.

6. A switch for an ac main line comprising:

first and second points of connection to respective portions of said ac main line that are to be selectively connected by said switch;

a transformer having a primary winding and a secondary winding, each having respective first and second ends, the first end of said primary winding connecting to said first point of connection, the turns ratio between said secondary and primary windings being sufficiently high that said transformer behaves as a current transformer with regard to said primary winding connection;

a relay switch, providing a main controlled current conduction path between its connections to said second point of connection and to a point on said primary winding, and having a control circuit for receiving a control signal that controls selective conduction through the main controlled current conduction path of said relay switch;

control means for applying said control signal to the control circuit of said relay switch; and means for supplying dc power to said control means, including:

means for rectifying at least a portion of the voltage appearing across said secondary winding when the said main controlled current conduction path of said relay switch provides closed-circuit conduction, and means for rectifying a portion of the voltage appearing between the second end of said primary winding and said second point of connection when the main controlled current conduction path of said relay switch is relatively open-circuit nonconductive.

7. A switch as set forth in claim 6 wherein said control means includes:

a sensor for generating electric signal indicative of a sensed physical parameter; and an amplifier, receptive of dc power from said means for supplying ac power to said control means, and responsive to said electrical signal indicative of a sensed physical parameter for generating said control signal.

8. A switch as set forth in claim 7 wherein said sensor is a passive infrared detector.

9. A switch as set forth in claim 6 wherein said means for rectifying a portion of the voltage appearing between the second end of said primary winding and said second point of connection includes:

a connection between the second end of said primary winding and the first end of said secondary winding;

means providing an impedance path between said second point of connection and the second end of said secondary winding; and means for rectifying at least a portion of the voltage appearing across said secondary winding irrespective of the condition of conduction through the main controlled current conduction path of said relay switch, included also in said means for rectifying at least a portion of the voltage appearing across said secondary winding when the main controlled current conduction path of said relay switch is relatively open-circuit nonconductive.

10. A switch as set forth in claim 9 wherein said means for providing an impedance path includes a capacitor having a first plate connected to said second point of connection and having a second plate connected to the second end of said secondary winding.

11. A switch as set forth in claim 6 wherein said means for rectifying a portion of the voltage appearing between the second end of said primary winding and said second point of connection includes:

a connection between the second end of said second winding and said secondary point of connection;

means providing an impedance path between the second end of said primary winding and the first end of said secondary winding; and means for rectifying at least a portion of the voltage appearing across said secondary winding irrespective of the condition of conduction through the main controlled current conduction path of said relay switch, included also in said means for rectifying at least a portion of the voltage appearing across said secondary winding when the main controlled current conduction path of said relay switch is relatively open-circuit nonconductive.

12. A switch as set forth in claim 11 wherein said means for providing an impedance path includes a capacitor having a first plate connected to the second end of said primary winding and having a second plate connected to the first end of said secondary winding.

13. A switch for an ac main line comprising:

first and second points of connection to respective portions of said ac main line that are to be selectively connected by said switch;

a transformer having a primary winding and a secondary winding each having respective first and second ends, the first end of said primary winding connecting to said first point of connection, the turns ratio between said secondary and primary windings being sufficiently high that said transformer behaves as a current transformer with regard to said primary winding connection;

a relay switch, providing a main controlled current conduction path between its connections to said second point of connection and to a point on said primary winding, and having a control circuit for receiving a control signal that controls selective conduction through the main controlled current conduction path of said relay switch;

means providing an impedance path between said second point of connection and the second end of said primary winding;

control means for applying said control signal to the control circuit of said relay switch; and means for supplying dc power to said control means, including:

means for rectifying at least a portion of the voltage appearing across said secondary winding.

14. A switch as set forth in claim 13 wherein said means for providing an impedance path includes a capacitor having a first plate connected to said second point connection and having a second plate connected to the second end of said primary winding.

* * * * *

UNITED STATES PATENT AND TRADEMARK OFFICE

CERTIFICATE OF CORRECTION

PATENT NO. : 4,713,598

DATED : December 15, 1987

INVENTOR(S) : Edgar M. Smith

It is certified that error appears in the above-identified patent and that said Letters Patent is hereby corrected as shown below:

Abstract, line 2 first word, change "applying" to --amplifier--

Column 4, line 2, after "supplying" change "ac" to --dc--.

Signed and Sealed this

Fourth Day of January, 1994

*Attest:*

*Attesting Officer*

Bruce Lehman

BRUCE LEHMAN

*Commissioner of Patents and Trademarks*